United States Patent [19]

Merklinger

[11] 4,282,693

[45] Aug. 11, 1981

[54] PREFABRICATED HOUSE

[76] Inventor: Richard Merklinger, Lange Str. 111, D-7570 Baden-Baden, Fed. Rep. of Germany

[21] Appl. No.: 74,145

[22] Filed: Sep. 10, 1979

[30] Foreign Application Priority Data

Nov. 18, 1978 [DE] Fed. Rep. of Germany ..... 2850085

[51] Int. Cl.[3] ..... E04B 1/00

[52] U.S. Cl. ..... 52/282; 52/295; 52/584

[58] Field of Search ..... 52/282, 293, 584, 79.1, 52/295, 270, 777, 772, 166

[56] References Cited

U.S. PATENT DOCUMENTS

| | | | |
|---|---|---|---|
| 63,725 | 4/1867 | Ipe | 52/166 |
| 2,177,699 | 10/1939 | Fisher | 52/772 X |
| 3,312,018 | 4/1967 | Fourmanoit | 52/282 X |
| 3,845,592 | 11/1974 | Patena | 52/293 X |

FOREIGN PATENT DOCUMENTS

| | | | |
|---|---|---|---|
| 228160 | 10/1943 | Switzerland | 52/282 |
| 281,667 | 7/1952 | Switzerland | 52/282 |

*Primary Examiner*—Carl D. Friedman
*Attorney, Agent, or Firm*—Craig and Antonelli

[57] ABSTRACT

A prefabricated house is provided which includes wall and corner support posts erected on a foundation, which posts are connected in their upper portions by frame members and carry wall elements. Each of the posts are formed of an inner and an outer stud which are clamped together with a fishplate mounted at the foundation, in such a manner as to also clamp the vertical edges of the wall elements supported thereby.

21 Claims, 5 Drawing Figures

PREFABRICATED HOUSE

BACKGROUND AND SUMMARY OF THE INVENTION

The invention relates to a prefabricated house of the type with posts erected on a foundation (wall posts and corner posts) connected by frames at their upper ends, as well as with wall elements inserted between the wall posts and corner posts, respectively.

The term "prefabricated house" is understood to mean, within the scope of this invention, buildings, the structural elements of which are prefabricated more or less extensively as a construction module and are merely assembled at the building site. In this arrangement, posts and frames constitute a load-bearing supporting structure in which the wall elements are inserted. In conventional prefabricated houses, the technique of concrete construction is the basis employed, i.e. posts and frames as well as essentially the wall elements are manufactured in the form of concrete or reinforced concrete parts, assembled at the site, and jointed with cement, mortar, or the like.

The above-described, customary mode of operation cannot be readily applied to building with wood. In wood construction, the blockhouse design is known, in essence, with timbers in horizontal superposition and the framework construction technique is primarily employed wherein the areas formed by posts and frames are filled out in various ways. Both aforementioned wood construction methods do not represent, strictly speaking, any prefabrication and moreover exhibit various disadvantages making their use impractical in modern wood construction. Both building methods are exraordinarily expensive in labor and material. Besides, in the block-type mode of construction, it is very difficult to attain a satisfactory seal and insulation. In the framework construction method, considerable static problems occur which can only be controlled by the voluminous use of trusses, tie beams, struts, diagonal reinforcements, etc., entailing considerable expenditure.

The invention is based on the problem of providing a prefabricated house of the type described in the foregoing which, with maximally complete prefabrication, can be erected economically, is distinguished by high stability, satisfies all requirements with respect to insulation and sealing features, and, in particular, makes it possible to meet these demands even in the wooden construction.

This problem is solved, according to particularly preferred embodiments of the invention by providing that each post consists of a baseplate, which latter can be connected to the foundation and can be leveled, this baseplate having at least one vertical fishplate attached thereto, as well as at least one inner stud and one outer stud, wherein the inner and outer studs are attached to the fishplate and each wall element is clamped in place along its vertical sides between respectively one inner stud and one outer stud.

Thus, according to the invention, the joining of the wall elements to one another and to the posts is attained by fashioning the posts in pairs and by clamping the wall elements between the outer and inner studs constituting the posts. Neighboring wall elements are, of course, clamped between outer and inner studs which are the same in pairs for both wall elements. This leads to a seal at the butt joints of neighboring wall elements, which seal is flawless under all circumstances; the wall elements proper can be readily designed so that they satisfy the requirements with respect to insulation and sealing.

While in the prefabricated house according to this invention, the connection to the foundation is ensured by the baseplates and fishplates, the entire construction is provided with an extraordinarily high static stability due to the feature of clamping the wall elements in place at the posts. In this connection, an aspect which is of high importance is that the wall elements—as contrasted to the area-filling character in the customary framework construction—themselves contribute toward the stability of the entire construction, due to their positive clamping engagement at the posts. A prefabricated house according to this invention can be most extensively built beforehand as a structural module and can be assembled at the site in a simple manner. It is of special importance herein that it is readily possible to design the structure as a wooden building, i.e. especially to make the posts and more or less extensively also the wall elements of wood; and that the techniques customary in wooden construction can be utilized during assembly. Basically, a prefabricated house according to this invention can be made of one floor as well as several floors, but primarily the mode of construction according to this invention is applicable to single-family homes with one to one-and-one-half floors.

The invention as described above relates, in particular, to the construction of the wall structure and its connection to the foundation. The structure and connection of the roof construction can be effected in the usual, conventional way and thus need no further explanation. The posts are extended, for this purpose, upwardly to the roof construction (for example up to the central roof beam or base joist).

The baseplate of each post preferably consists of a steel plate to which the fishplate is welded. The fishplate can consist of a simple flat steel plate or—considering the provision of greater ruggedness—it can have a cross-shaped cross section in such a way that mutually opposed cross legs point in the direction of the outer or inner stud and engage corresponding grooves of these studs. A connection of the baseplates to the foundation permitting a leveling step can be attained by providing each baseplate with three passage bores arranged at the corners of a triangle and encompassing respectively one stay bolt attached in the foundation and equipped with a thread; by means of nuts, the baseplate can be adjusted in height, leveled, and fixed in position with respect to the stay bolt. After the leveling step, cement is poured under the baseplate.

At the wall posts where two wall elements abut planar, the baseplates are preferably arranged so that the connecting line of two passage bores extends in the direction of the wall whereas, at corner posts, where wall elements abut with the formation of a corner, the two connecting lines of the passage bores extend in the direction of the abutting walls. The contour of the baseplate is preferably triangular in correspondence with the arrangement of the passage bores.

The outer and inner studs of each post have mutually facing, parallel, planar clamping surfaces, by means of which they contact the fishplate and/or the wall elements to be clamped in place, so that a firm composite structure results in the zone of each post. The following description is based on the assumption that the inner studs directly contact the fishplate and that the outer studs are braced against the fishplate and the inner stud with the inclusion of the wall elements. Alternative embodiments are contemplated with a reverse arrangement.

With a view toward a simple assembly, it is advantageous to provide that the inner stud and the outer stud can be braced (tensioned) independently of each other by means of screw bolts with the fishplate. This can be realized, for example, by making the inner stud and the outer stud braceable by means of common threaded bolts which penetrate the fishplate and are connected nonrotatably and non-displaceably with the fishplate, for example by welding. It is also contemplated to provide respectively separate threaded bolts for the inner and outer studs; in this connection, it is possible, especially by a countersunk arrangement and/or a suitable selection of the bolt heads, to make the threaded bolts releasable from the outside. In addition to the threaded bolts arranged in the zone of the fishplate, it is contemplated in certain embodiments to directly brace the outer and inner studs together by means of additional threaded bolts distributed along their lengths, to obtain an even stronger composite connection with the wall elements.

At least in the zone of the fishplate, it is advantageous to provide the inner or outer stud in contact with this fishplate with a groove on the side facing the fishplate, the latter engaging this groove in a flush manner so that a flat contact of the wall elements at the stud is ensured.

The frames interconnecting the posts in the upper zone are provided, according to a further teaching of this invention, in pairs and consist of respectively one inner frame and one outer frame joined to the inner studs or to the outer studs from the inside and from the outside, respectively. In other words either the inner studs or the outer studs, preferably the inner studs, are clamped in place between the frames arranged in pairs, which is preferably accomplished by means of threaded bolts. In this arrangement, the outer studs terminate underneath the outer frames whereas the inner studs—as explained above—extend all the way up to the roof structure. A ceiling construction is erected on the frames in the usual way with beams, panels, etc. laid on top thereof. In the areas remaining between the frames, the beams, and the ceiling construction, headers (bridging members) are inserted which—just as the wall elements described hereinbelow—are of a framework construction and can optionally also be fashioned as a skylight. The headers are preferably braced at the frames along their bottom sides, fixed in place along their topsides by the correspondingly constructed roof structure, and sealed with respect to the beams along the sides by sealing inserts, tongue-and-groove joints, or the like.

The wall elements are preferably fashioned in frame construction filled by a paneling constructed in correspondence with the respective requirements regarding thermal and sound insulation, weatherability, etc. and being made up of multiple layers as a rule. Within the filling, reinforcements for the frame construction can, of course, be extended. The wall elements are clamped along the sides—as explained above—between outer and inner studs of the posts. It is furthermore advantageous to dimension the wall elements with respect to their height so that they extend in between the inner and outer frames and consequently are also clamped in position along their topsides. This achieves the required sealing effect and simultaneously further improves the static stability due to the force-derived connection to the frames. On the underside, the wall elements can be sealed with respect to the foundation by plaster flooring which simultaneously exerts a supporting function. It is advantageous to attach to the underside of the wall elements a covering strip placed in front of the flooring, improving the external appearance of the house and furthermore facilitating the production of the flooring. It is finally recommended to take care, by a suitable dimensioning of the wall elements, that a gap exists between neighboring wall elements, closed off by the inner and outer studs, ensuring venting or aeration advantageous for the wooden building elements.

The inner walls, in an embodiment which is to be preferred, consist of room divider elements shape-matingly inserted between the posts (without force-derived clamping action), which room divider elements are grooved along the narrow sides, whereas strips adapted to the grooves are provided at the inner studs along the inner sides facing the room divider elements. The room divider elements preferably likewise consist of a frame construction equipped in the usual way with a filling material meeting the requirements regarding sound and heat insulation etc. The strips provided for the shape-mating connection between the inner stud and the room divider elements, which strips are preferably made of hardwood, can advantageously be attached to the insides of the inner studs and secured by a tongue-and-groove joint. The installation of the room divider elements takes place during the course of erecting the house in such a way that the room divider elements are inserted, prior to constructing the ceilings, from above between the posts. The joints between the room divider elements and the neighboring inner studs, in certain cases also between the ceiling and the floor, can be sealed by sealing inserts or by the subsequent introduction of a sealing compound.

An advantage attained by the pairwise arrangement of the frames with inner and outer frame members resides in that it is made possible to insert blinds, which may be provided, above the wall elements—provided with windows—in the interstice between the inner and outer frames. The blind can be passed through and guided, for example, by providing on the outside of the wall elements a recess open at the topside (the cross section of this recess corresponding essentially to the cross section of the blind) and by arranging guide means for the blind along the lateral boundaries. In the zone of the recess, the clamping and sealing of the topside of the wall elements with respect to the outer frames are, of course, omitted. In general, but especially in the zone of such blind recesses, it is thus recommended to insert cover plates for sealing purposes on the inside between the wall element and the inner frame. Such cover plates can furthermore also be arranged between the blinds inserted above the wall elements and the inner frame. In any event there is the possibility of fashioning the cover plates as fill-in wood elements of corresponding buckling strength and use same at the same time as an abutment for the clamping of wall elements and/or blinds between the inner and outer frames.

The above-description has addressed itself essentially to the wall posts arranged along the course of a linearly extending wall. In the zone of the house corners, special measures are provided. Here, the invention teaches, first of all, to equip the corner posts with respectively one baseplate with two fishplates arranged in mutual inclination in accordance with the corner angle. Basically, a corner can be formed by associating with the two abutting wall elements respectively one outer stud and one inner stud. However, the corners can also be closed in an especially simple way by the feature that the corner posts have respectively one single inner stud which, so to speak, represents a corner pillar, and can be braced together with both fishplates of the baseplate, wherein the threaded bolts of at least one fishplate are detachable. The detaching of at least one of the threaded bolts is necessary to place the inner stud into the angle formed by the fishplates. If the fishplates (as explained above) are of the shape of a cross in cross section and/or engage in grooves of the inner stud, it is necessary to remove the threaded bolts of both fishplates, to lower the inner stud from above in between the fishplates, and only thereafter to insert the threaded bolts.

For clamping the wall elements in position at the inner stud constituting the corner, various possibilities can be employed according to the invention. Thus, an angular molding, the angle legs of which have a thickness corresponding to the wall elements, can be placed in front of the outer edge of the inner stud, both outer studs extending over this angular molding. The angle legs form abutments for the outer studs which are placed in front thereof for bracing purposes. The surface on the outside of the angular molding corresponds here, for design reasons, preferably to the surface of the wall elements. Another possibility resides in placing, in front of each of the wall elements braced against a corner stud, an outer stud having an angular cross section, one leg of this stud resting against the inner stud. This supporting leg absorbs the clamping stress and has a length on the inside of the profile which corresponds to the thickness of the wall element.

The advantages attained by this invention reside essentially in that a prefabricated house construction is provided which can be made of wood economically and without difficulties; provides high stability as well as optimum insulation and sealing features; and permits extensive prefabrication. With respect to design viewpoints, it is of special importance that all structure-forming elements (studs, frames, etc.) are clearly visible and convey an unobstructed, functional outward appearance. This holds true—with a desirable, rustic slant—especially in the wooden type of construction contemplated primarily in this invention, wherein the frame, the studs, the framework constructions of wall elements and room divider elements etc. are made of wood, preferably of glued-together wood.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
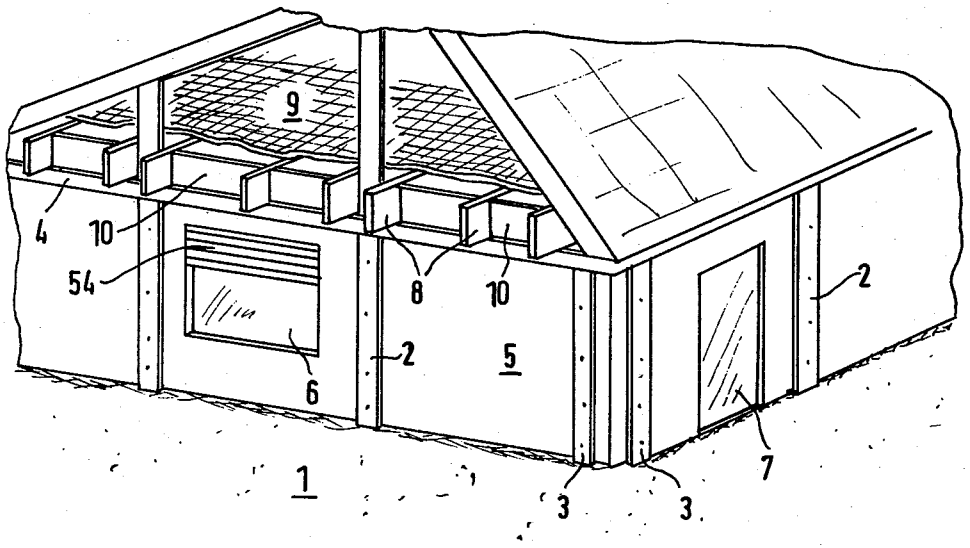
FIG. 1 is a partial perspective view of a prefabricated house constructed in accordance with the present invention.

In the prefabricated house illustrated in FIG. 1, the wall construction consists essentially of vertical posts, namely wall posts 2 and corner posts 3 erected on the foundation 1, and of frames 4 retaining the posts 2, 3 in their upper zone. Wall elements 5 are inserted in between the posts 2, 3, which wall elements can be provided with windows 6 or doors 7, as required. Wall posts 2 are found as the supporting elements in the linear extension of a wall, whereas walls extending at a mutual angle meet at the corner posts 3. FIG. 1 indicates how the posts 2, 3 are extended upwardly past the frames 4 and are connected to a roof construction, which latter need not be described in detail since known roof constructions can be used. Beams 8 are placed on the frames 4, a ceiling 9 being erected in the usual way on these beams. The ceiling 9 separates the upper floor from the lower floor in the illustrated embodiment. Headers 10 are inserted in the areas remaining between the frames 4, the beams 8, and the ceiling 9, which headers can also be fashioned as skylights.

The illustrated prefabricated house consists of prefabricated building components forming a construction module, these components having been mounted to the foundation 1 right at the site. This will be explained in greater detail below with reference to FIGS. 2 and 3 for the wall posts 2 and with reference to FIGS. 4*a* and 4*b* for the corner posts 3.

The posts 2, 3 first of all, each have a baseplate 11 of an essentially triangular outline, this baseplate being provided with three passage bores 12 arranged at the apices of a triangle. Each passage bore 12 is penetrated by a stay bolt 14 fastened in the foundation 1 by means of an anchor 13. Two nuts 15 are provided on each stay bolt 14, by means of which the baseplate 11 can be adjusted in its height above the foundation 1, leveled, and fixed in position. The interspace between the foundation 1 and the baseplate 11 is filled with cement, mortar, or the like after leveling.

Figure 2:
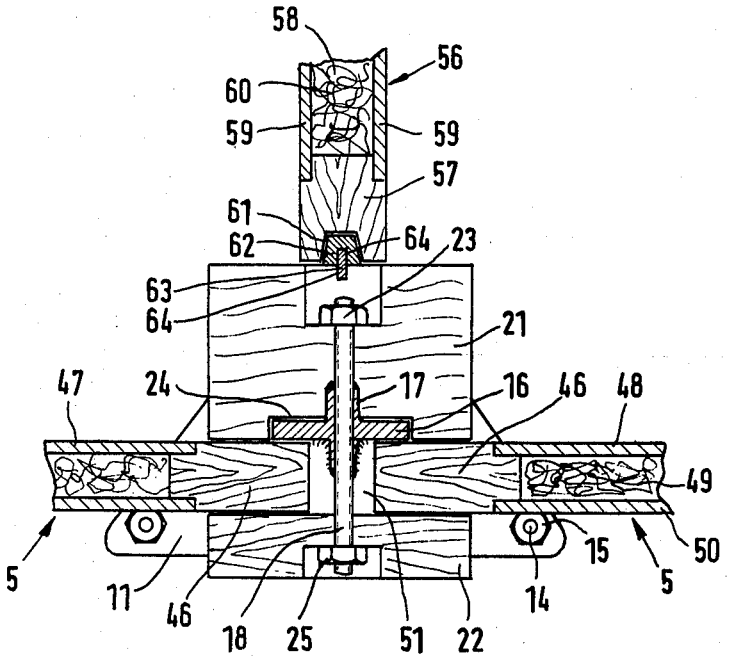
FIG. 2 shows details of the connection of wall posts in the embodiment of FIG. 1, in a horizontal sectional view on an enlarged scale.
Figure 3:
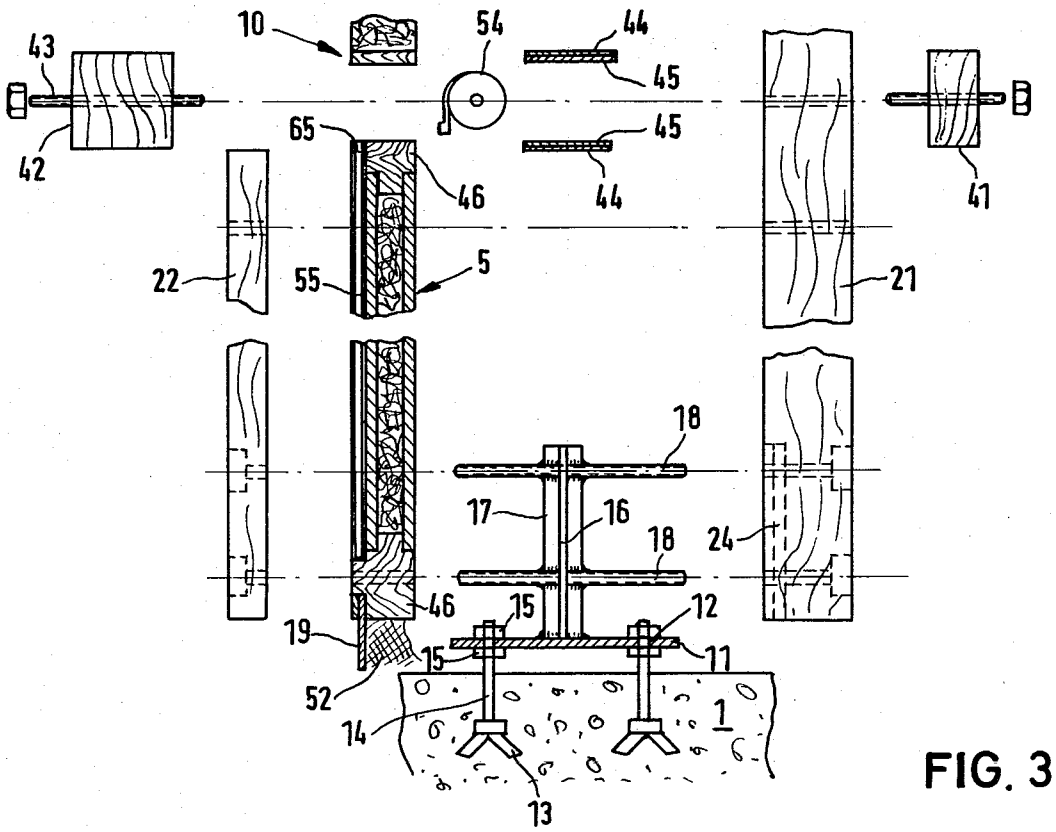
FIG. 3 shows the detail of FIG. 2 and additional upper frame details in a lateral view in an exploded representation.

A fishplate 16 having a cruciform cross section is welded to the topside of the baseplate 11. This fishplate 16 extends in parallel to the connecting line of two bores 12 and is reinforced by narrow legs 17 oriented at right angles thereto. Two threaded bolts 18 are welded into the fishplate 16 in superposed relationship; these bolts being provided with a thread on both sides. The wall posts 2, as shown in FIGS. 2 and 3, are made up of a pair of studs consisting of an inner stud 21 and an outer stud 22. The inner stud 21 is clamped to the fishplate 16 from the inside of the house by means of the threaded bolts 18 and nuts 23 threaded thereon and countersunk in the inner stud 21. On the end face which faces the fishplate 16, the inner stud 21 has a groove 24 into which the fishplate 16 is countersunk so that it is flush (except for the outer, narrow reinforcing leg 17). Once the inner stud 2 has been braced against the fishplate 16, independently of the outer stud 22, the wall elements 5 are placed against the outsides of the inner stud 21 and the fishplate 16, respectively. The outer stud 22 which, just as the inner stud 21, has corresponding bores for the threaded bolts 18, is placed thereon and braced with respect to the flange 16 from the outside by means of nuts 25, thus clamping the wall elements 5 into position. Thus, the wall elements 5 are firmly joined with each other as well as with the foundation 1.

Figure 4B:
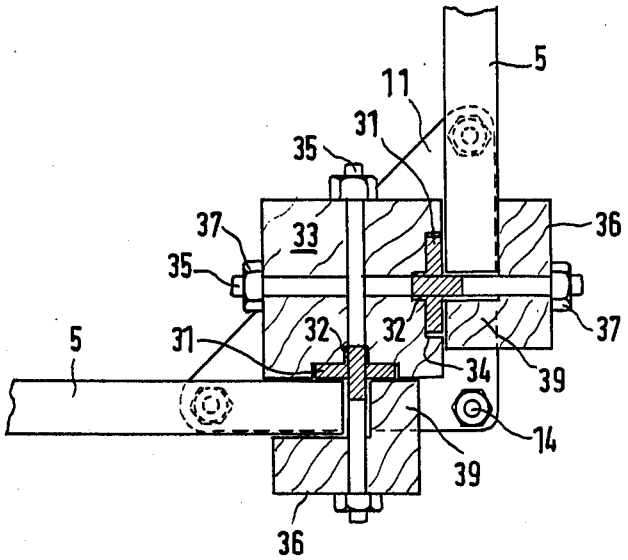
FIG. 4*b* shows details of a second embodiment of the connection of corner posts in the embodiment of FIG. 1, on an enlarged scale in a horizontal sectional view.
Figure 4A:
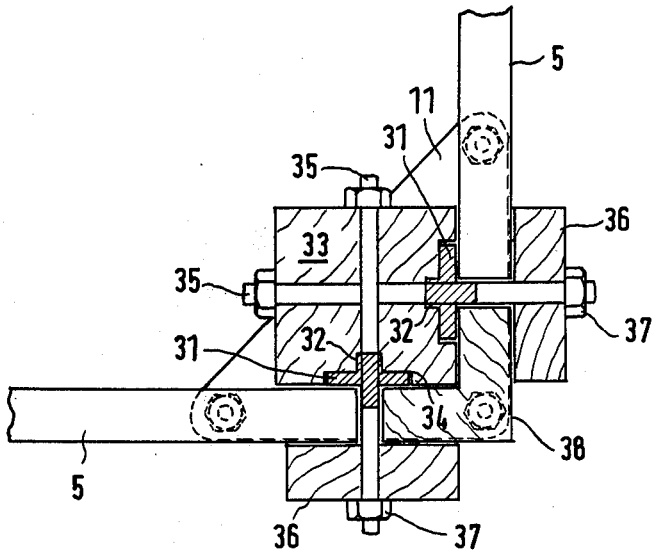
FIG. 4*a* shows details of a first embodiment of the connection of corner posts in the embodiment of FIG. 1, on an enlarged scale in a horizontal sectional view.

The corner posts 3 (see FIGS. 4*a* and 4*b*) are basically of a similar construction, but adapted to the corner connection of wall elements. Two fishplates 31 are welded to the baseplate 11. These fishplates 31 are arranged in accordance with the corner angle perpendicularly to each other and are likewise of a cruciform profile with short reinforcing legs 32. The connecting lines of the passage bores 12 form, just as in the baseplates 11 of the wall posts, 2, a right-angled isosceles triangle. In the case of the corner post 3, differently from the wall post 2, the short sides of the triangle extend in the direction of the wall elements 5 converging at the illustrated corner. Between the fishplates 31, a single inner stud 33 is inserted, common to both converging wall elements 5. This stud 33 is lowered into position from above so that the fishplates 31 engage the grooves 34 provided for this purpose along the outer sides of the inner stud 33. After insertion of the inner stud 33 between the fishplates 31, the threaded bolts 35 are inserted. The wall elements 5 are placed against the outsides of inner stud 33 and fishplates 31, respectively, and clamped in position by means of the outer legs 36 and nuts 37 threaded onto the threaded bolts 35. Two possibilities are represented in FIGS. 4*a* and 4*b* in this connection. In case of FIG. 4*a*, an angled strip 38 is placed in front of the outer edge of the inner stud 33, the angle legs of this strip having a thickness corresponding to that of the wall elements 5. Each outer leg 36 is supported, on the one hand, on the wall element 5 and, on the other hand, on one of the angle legs of the angled strip 38. In case of FIG. 4*b*, each of the two wall elements 5 is preceded by an individual outer stud 36 which in this case has an angular cross section with an integrally attached supporting leg 39 by means of which the outer stud is supported directly on the inner stud 33. The length of the supporting leg 39 (measured along the inside) corresponds to the thickness of the wall elements 5. In a deviation from the illustrated embodiments, the fishplates 31 can also be fashioned to be of one piece.

The posts 2, 3 are interconnected in their upper zone by frames 4, as described above. The frames 4 are likewise provided in pairs and consist each of an inner frame member 41 and an outer frame member 42 (FIG. 3). The inner frame members 41 are placed from the inside against the inner studs 21 and 33, respectively, and the outer frame members 42 are placed from the outside against these studs and are clamped together by means of threaded bolts 43. The outer studs 22 and 36, respectively, abut underneath the outer frame members 42 in this arrangement and are correspondingly shorter than the respective inner studs.

The outer frame members 42 extend over the wall elements 5 as well as over the headers 10 which thereby are braced from the outside against the inner studs 21 and 33. A positive connection over the width of the wall elements 5 and/or the headers 10 between these and the inner frame members 41 is attained by cover plates 44 arranged on the inside of the wall elements 5 and/or headers 10 and resting as abutments on the inner frame members 41. The cover plates 44 have a thickness corresponding to the required buckling strength and are furthermore provided with an insulating layer 45 of synthetic resin foam.

As described above, beams 8 are placed on the inner and outer frame members 41, 42, the ceiling 9 being arranged thereon in the usual fashion. The beams 8 are arranged in pairs on both sides of respectively one post 2, 3 and are otherwise disposed individually. FIG. 1 furthermore shows how the beams 8 project beyond the outer frame members 42 for visual effects.

The wall elements 5 constituting the outer walls consist of a frame construction made up of wood frame members 46 filled in by paneling 47 inserted therein, having a layered structure and made up, for example (from the inside toward the outside) of plasterboard 48, an insulation and vapor barrier layer 49, and a profiled paneling 50 (e.g. fiberboard). The width of the wall elements 5 is dimensioned so that there remains between neighboring wall elements 5 a gap 51 (closed off by the inner and outer studs), effecting a venting action.

The wall elements 5 are clamped, as described above, along their vertical sides and along the topside between studs and/or frames in a sealing fashion. On the underside of the wall elements 5, a cover strip 19 is respectively inserted. To seal the wall elements 5 with respect to the foundation 1, the interspace behind the cover strip 19 is filled up with a flooring plaster 52.

Insofar as roller blinds 54 are provided—in the zone of the windows 6 or doors 7—these are mounted respectively above the wall elements 5 in the interspace between the inner frame member 41 and the outer frame member 42. The blind 54 is passed through by providing the wall elements 5 with a recess 55 open in the upward direction, i.e. toward the interspace. The cross section of this recess corresponds to the cross section of the roller blind 54. To guide the roller blind 54, U-shaped guide tracks 65 are mounted along the lateral limits of the recess 55, oriented toward the latter.

The inner walls consist of room divider elements 56 flushly inserted between wall posts 2; these room divider elements likewise consist of a frame construction made up of wooden frame members 57 and a multiple-layered filling panel 58 inserted therein. In correspondence with the different requirements the filling panel 58 of the room divider elements 56 is made up of respectively one outer plasterboard layer 59 and an interposed insulating layer 60.

The vertical wooden frame members 57 of the room divider elements 56 have respectively one groove 61 along the end faces facing the inner studs 21. Strips 62 engage flushly into the grooves 61, these strips being attached to the corresponding insides of the inner studs 21. The strips 62 are mounted to the inner studs 21 by means of tongues 63 engaging in corresponding grooves 64 of the strips 62, on the one hand, and of the inner studs 21, on the other hand. The room divider elements 56 are inserted, during assembly, prior to placing the beams 8 from above, in between the inner studs 21 from above, establishing a shape-mating connection between the grooves 61 and the strips 62. To provide a seal between the room divider elements 56 and the inner studs 21 and/or the floor and the ceiling, sealing inserts (not shown) can be provided, or a sealing compound can be subsequently injected, if there are special requirements regarding the sealing function.

Once the vertical walls of a prefabricated house have been erected in the above-described way, the roof construction can be added in the usual manner, which need not be described in detail herein.

While I have shown and described several embodiments in accordance with the present invention, it is understood that the same is not limited thereto but is susceptible to numerous changes and modifications as known to those skilled in the art and I therefore do not wish to be limited to the details shown and described herein but intend to cover all such changes and modifications as are encompassed by the scope of the appended claims.

I claim:

1. Prefabricated house with wall and corner support posts erected on a foundation, these posts being connected in their upper zone by frames, as well as with wall elements inserted between the wall posts and corner posts, respectively, wherein each post includes:

a baseplate, baseplate connecting means for connecting the baseplate to the foundation, at least one vertical fishplate connected to the baseplate, at least one inner stud and one outer stud, and attaching means fixedly secured to said fishplate and extending therefrom in opposing directions for detachably attaching the inner and outer studs to the fishplate independently of each other and with a wall element clamped along its vertical sides between respectively one inner stud and one outer stud.

2. Prefabricated house according to claim 1, wherein the baseplate is constructed as a triangular plate and has three passage bores arranged at the corners of a triangle, and wherein said baseplate connecting means includes threaded stay bolts fixedly anchorable within the foundation and extendible into said passage bores, and with connecting nuts for adjustments in height of the triangular plate with respect to the stay bolt.

3. Prefabricated house according to claim 1, wherein the attaching means includes threaded connecting bolts, and wherein the inner and outer studs are braceable against the fishplate by means of the threaded connecting bolts.

4. Prefabricated house according to claim 1, wherein the attaching means includes threaded connecting bolts, and wherein the inner studs and the outer studs are braceable by means of the threaded bolts common to both inner and outer studs, which threaded bolts penetrate the fishplate and are nonrotatably and non-displaceably connected to the fishplate.

5. Prefabricated house according to claim 1, wherein one of the inner and outer studs respectively has a groove on an end face facing the fishplate; and wherein the fishplate engages into the groove in a flush manner.

6. Prefabricated house according to claim 1, wherein the frames comprise an inner frame member and an outer frame member clamped from the inside and the outside of the inner and outer studs, respectively.

7. Prefabricated house according to claim 6, wherein the wall elements are sealingly clamped along their topsides between the outer and inner frame members and are sealed along their undersides with respect to the foundation by means of a flooring plaster.

8. Prefabricated house according to one of claims 6, wherein roller blinds are inserted in an interspace between the inner and outer frame members.

9. Prefabricated house according to claim 8, wherein a recess open at the topside and intended for the roller blind is provided on the outside of the wall elements; and wherein guide means for the roller blind are arranged along the lateral boundaries of the recess.

10. Prefabricated house according to claim 1, wherein a gap, closed off by the inner and outer studs, exists between neighboring wall elements when in assembled position.

11. Prefabricated house according to claim 1, further comprising inner walls formed of room divider elements shapematingly inserted between a pair of the posts; wherein the room divider elements have grooves along their narrow sides; and wherein the inner studs on the insides facing the room divider elements have strips adapted to matingly engage the grooves.

12. Prefabricated house according to claim 11, wherein the strips are placed on the insides of the inner studs and are secured by means of a groove and tongue connection.

13. Prefabricated house according to claim 1, 3 or 11 wherein the corner posts each have a baseplate with two of said fishplates arranged in mutual inclination in correspondence with the corner angle.

14. Prefabricated house according to claim 13, wherein the corner posts each have a single inner stud which can be clamped in position by means of both fishplates, and wherein the threaded bolts of at least one of the fishplates are detachable.

15. Prefabricated house according to claim 14, wherein an angular molding, the angle legs of which have a thickness corresponding to the wall elements, is placed in front of the outer edge of the inner stud of respective corner posts, this angular molding being overlapped by both outer studs.

16. Prefabricated house according to claim 14, wherein an outer stud having an angular cross section is placed in front of each of the wall elements braced against a corner post, one leg of this outer stud being supported on the inner stud.

17. Prefabricated house according to claim 13, wherein an angular molding, the angle legs of which have a thickness corresponding to the wall elements, is placed in front of the outer edge of the inner stud of respective corner posts, this angular molding being overlapped by both outer studs.

18. Prefabricated house according to claim 13, wherein an outer stud having an angular cross section is placed in front of each of the wall elements braced against a corner post, one leg of this outer stud being supported on the inner stud.

19. Prefabricated house according to any one of claims 3, or 4, or 5, wherein the baseplate is constructed as a triangular plate and has three passage bores arranged at the corners of a triangle, and wherein said baseplate connecting means includes threaded stay bolts fixedly anchorable within the foundation and extendible into said passage bores, and with connecting nuts for adjustments in height of the triangular plate with respect to the stay bolt.

20. Prefabricated house according to claim 1, wherein said inner and outer studs are wood members.

21. Prefabricated house according to claim 20, wherein said baseplate is a metal member.

* * * * *